US010012099B2

(12) United States Patent
Cetel et al.

(10) Patent No.: US 10,012,099 B2
(45) Date of Patent: Jul. 3, 2018

(54) THIN SEAL FOR AN ENGINE

(71) Applicant: United Technologies Corporation, Hartford, CT (US)

(72) Inventors: Alan D. Cetel, West Hartford, CT (US); Dilip M. Shah, Glastonbury, CT (US); Eric A. Hudson, Harwinton, CT (US); Raymond Surace, Newington, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 15/004,591

(22) Filed: Jan. 22, 2016

(65) Prior Publication Data

US 2017/0211401 A1 Jul. 27, 2017

(51) Int. Cl.
*F01D 11/00* (2006.01)
*F01D 25/00* (2006.01)

(52) U.S. Cl.
CPC ..... *F01D 11/005* (2013.01); *F01D 25/005* (2013.01); *F05D 2220/32* (2013.01); *F05D 2230/10* (2013.01); *F05D 2230/21* (2013.01); *F05D 2230/26* (2013.01); *F05D 2230/90* (2013.01)

(58) Field of Classification Search
CPC .. F01D 11/005; F01D 25/005; F05D 2230/21; F05D 2230/90; F05D 2230/10; F05D 2230/26; F05D 2220/32
See application file for complete search history.

(56) References Cited

U.S. PATENT DOCUMENTS

| | | | |
|---|---|---|---|
| 3,092,393 | A | 6/1963 | Morley |
| 3,803,890 | A | 4/1974 | Connell |
| 4,924,581 | A | 5/1990 | Jakobsen |
| 5,531,457 | A | 7/1996 | Tibbott |
| 5,545,003 | A | 8/1996 | O'Connor |
| 5,810,552 | A | 9/1998 | Frasier |
| 6,193,141 | B1 | 2/2001 | Burke |
| 6,255,000 | B1 | 7/2001 | O'Connor |
| 6,299,178 | B1 | 10/2001 | Hailing |
| 6,568,384 | B1 | 5/2003 | Onizaki |
| 6,626,440 | B2 | 9/2003 | Hailing |
| 7,918,265 | B2 | 4/2011 | Verner |

(Continued)

OTHER PUBLICATIONS

Ken Harris, "Improved Single Crystal Superalloys, CMSX-4 (SLS) [La+Y] and CMSX-486", The Minerals, Metals & Materials Society (TMS), Superalloys 2004, 2004.

(Continued)

*Primary Examiner* — Moshe Wilensky
(74) *Attorney, Agent, or Firm* — O'Shea Getz P.C.

(57) ABSTRACT

Aspects of the disclosure are directed to a seal configured to interface with at least a first component and a second component of a gas turbine engine. A method for forming the seal includes obtaining an ingot of a fine grained, or a coarse grained, or a columnar grained or a single crystal material from a precipitation hardened nickel base superalloy containing at least 40% by volume of the precipitate of the form Ni3(Al, X), where X is a metallic or refractory element, and processing the ingot to generate a sheet of the material, where the sheet has a thickness within a range of 0.010 inches and 0.050 inches inclusive.

9 Claims, 8 Drawing Sheets

(56) References Cited

U.S. PATENT DOCUMENTS

| | | | | |
|---|---|---|---|---|
| 8,651,497 | B2 | 2/2014 | Tholen | |
| 2004/0239053 | A1 | 12/2004 | Rowe et al. | |
| 2010/0290891 | A1 | 11/2010 | Pakkala | |
| 2011/0081235 | A1 | 4/2011 | Shah et al. | |
| 2012/0319362 | A1 | 12/2012 | Tholen et al. | |
| 2016/0008867 | A1* | 1/2016 | Shah | B21D 51/02 428/592 |
| 2016/0312894 | A1 | 10/2016 | McCaffrey et al. | |

OTHER PUBLICATIONS

Jesse Newman, "Novel Ultra-High Temperature Metal Seal with Single Crystal Spring Energizer", 45th AIAA/ASME/SAE/ASEE Joint Propulsion Conference & Exhibit, Denver, Colorado, AIAA 2009-5169, Aug. 2-5, 2009.

Siemens Westinghouse Power Corporation, "Advanced Turbine Systems Program Phase III Technical Progress Final Report", available from: <http://www.osti.gov/scitech/servlets/purl/828617>, Apr. 21, 2004.

Raymond E. Chupp, "Turbomachinery Clearance Control", Turbine Science and Technology, available from: <http://ntrs.nasa.gov/archive/nasa/casi.ntrs.nasa.gov/20070005016.pdf> as of Dec. 2, 2015.

Pawel Jozwik, "Applications of Ni3Al Based Intermetallic Alloys—Current Stage and Potential Perceptivities", Materials 2015 ISSN 1996-1944, May 13, 2015.

Wikipedia.org, "Electrical Discharge Machining", available from: <https://en.wikipedia.org/wiki/Electrical_discharge_machining> as of Dec. 3, 2015.

Comco, "Micro-Abrasive Blasting Solutions for the Semiconductor Industry", available from: <http://www.comcoinc.com/wp-content/uploads/2013/03/SemiconductorApps.pdf>, 2013.

Hydro Lazer, "Hydro-Lazer Abrasive Waterjet Cutting Services—Avail When Extremely Smooth Finish is Desired", available from: <http://www.hydro-lazer.com/services/abrasive-waterjet-cutting> as of Dec. 3, 2015.

EP search report for EP17152586.8 dated Jun. 13, 2017.

* cited by examiner

THIN SEAL FOR AN ENGINE

BACKGROUND

In connection with modern aircraft, a gas turbine engine generally includes a compressor section to pressurize an airflow, a combustor section to burn a hydrocarbon fuel in the presence of the pressurized air, and a turbine section to extract energy from the resultant combustion gases. Seals are used in such engines to isolate a fluid from one or more areas/regions of the engine. For example, seals are used to control various characteristics (e.g., temperature, pressure) within the areas/regions of the engine and can be useful to ensure proper/efficient engine operation and stability.

There are limits to the characteristics that seals can accommodate based on their material properties. For example, conventional turbine airfoil seals incorporate materials that limit their use to environments that are less than 2000 degrees Fahrenheit (1093 degrees Celsius). Trends in engine development have dictated that engine core operating temperatures increase. What is needed are seals that are capable of reliably accommodating such elevated temperatures so as to not serve as a limiting factor in the design of an engine. In addition, other technological advancements in turbine design have driven the need for seals with increased strength.

BRIEF SUMMARY

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

Aspects of the disclosure are directed to a method for forming a seal configured to interface with at least a first component and a second component of a gas turbine engine, the method comprising: obtaining an ingot of a fine grained, or a coarse grained, or a columnar grained or a single crystal material from a precipitation hardened nickel base superalloy containing at least 40% by volume of the precipitate of the form Ni3(Al, X), where X is a metallic or refractory element, and processing the ingot to generate a sheet of the material, where the sheet has a thickness within a range of 0.010 inches and 0.050 inches inclusive. In some embodiments, the sheet is substantially shaped as at least one of a rectangle or a cube. In some embodiments, the material includes nickel. In some embodiments, the processing of the ingot includes applying an electro discharge machining technique. In some embodiments, the processing of the ingot includes applying an abrasive material cutting technique. In some embodiments, the processing of the ingot includes applying a blasting technique. In some embodiments, at least one of the obtaining or the processing includes applying a casting technique. In some embodiments, the processing of the ingot includes applying a rolling technique. In some embodiments, application of the rolling technique provides a flat, single curve, or compound curve sheet. In some embodiments, the method comprises forming a notch or slot in the sheet to accommodate an interface associated with at least one of the first component or the second component. In some embodiments, the method comprises forming an arc or bent tab in the sheet. In some embodiments, the method comprises applying at least one of a thermal barrier coating or an oxidation resistant metallic coating to the sheet in forming the seal. In some embodiments, the metallic or refractory element includes at least one of Ti, Ta, or Nb.

Aspects of the disclosure are directed to a system associated with a gas turbine engine, the system comprising: a seal configured to interface at least a first component and a second component, the seal formed from a sheet of a single crystal material, the sheet having a thickness within a range of 0.010 inches and 0.050 inches inclusive. In some embodiments, the system comprises the first component and the second component. In some embodiments, the first component includes at least one of: a static turbine airfoil, a rotating a method for forming a seal configured to interface with at least a first component and a second component of a gas turbine engine, the method comprising: obtaining an ingot of a fine grained, or a coarse grained, or a columnar grained or a single crystal material from a precipitation hardened nickel base superalloy containing at least 40% by volume of the precipitate of the form Ni3(Al, X), where X is a metallic or refractory element, and processing the ingot to generate a sheet of the material, where the sheet has a thickness within a range of 0.010 inches and 0.050 inches inclusive. In some embodiments, the sheet is substantially shaped as at least one of a rectangle or a cube. In some embodiments, the material includes nickel. In some embodiments, the processing of the ingot includes applying an electro discharge machining technique. In some embodiments, the processing of the ingot includes applying an abrasive material cutting technique. In some embodiments, the processing of the ingot includes applying a blasting technique. In some embodiments, at least one of the obtaining or the processing includes applying a casting technique. In some embodiments, the processing of the ingot includes applying a rolling technique. In some embodiments, application of the rolling technique provides a flat, single curve, or compound curve sheet. In some embodiments, the method comprises forming a notch or slot in the sheet to accommodate an interface associated with at least one of the first component or the second component. In some embodiments, the method comprises forming an arc or bent tab in the sheet. In some embodiments, the method comprises applying at least one of a thermal barrier coating or an oxidation resistant metallic coating to the sheet in forming the seal. In some embodiments, the metallic or refractory element includes at least one of Ti, Ta, or Nb turbine airfoil, or a segmented blade outer air seal. In some embodiments, the first component includes at least one of: a platform, a mate face, a buttress, a spindle, a boss, a rail, or a hook. In some embodiments, the seal includes one or more notches, slots, tabs, or arcs to accommodate interfaces associated with at least one of the first component, the second component, or a second seal. In some embodiments, the seal is configured to accommodate operation within the engine at least at a temperature of 2000 degrees Fahrenheit.

BRIEF DESCRIPTION OF THE DRAWINGS

The present disclosure is illustrated by way of example and not limited in the accompanying figures in which like reference numerals indicate similar elements. The figures are not necessarily to scale unless specifically indicated otherwise.

DETAILED DESCRIPTION

Figure 1:
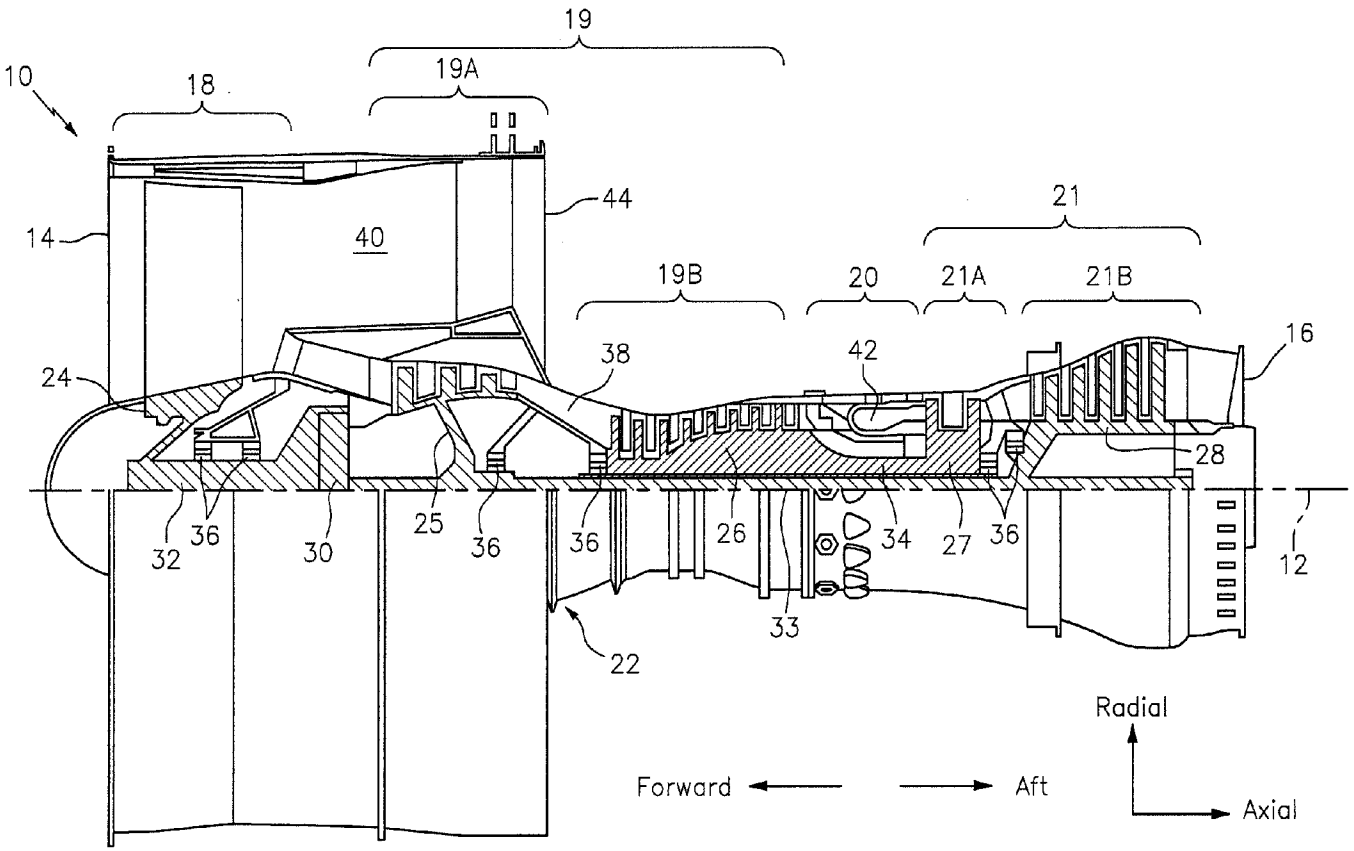
FIG. 1 is a side cutaway illustration of a geared turbine engine.

It is noted that various connections are set forth between elements in the following description and in the drawings (the contents of which are included in this disclosure by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities.

In accordance with various aspects of the disclosure, apparatuses, systems, and methods are described for providing a material (e.g., a single crystal material) that may be used to form a seal. The material may be generated using one or more techniques. In some embodiments, a rolling technique may be applied to improve fatigue resistance.

Aspects of the disclosure may be applied in connection with a gas turbine engine. FIG. 1 is a side cutaway illustration of a geared turbine engine 10. This turbine engine 10 extends along an axial centerline 12 between an upstream airflow inlet 14 and a downstream airflow exhaust 16. The turbine engine 10 includes a fan section 18, a compressor section 19, a combustor section 20 and a turbine section 21. The compressor section 19 includes a low pressure compressor (LPC) section 19A and a high pressure compressor (HPC) section 19B. The turbine section 21 includes a high pressure turbine (HPT) section 21A and a low pressure turbine (LPT) section 21B.

The engine sections 18-21 are arranged sequentially along the centerline 12 within an engine housing 22. Each of the engine sections 18-19B, 21A and 21B includes a respective rotor 24-28. Each of these rotors 24-28 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 24 is connected to a gear train 30, for example, through a fan shaft 32. The gear train 30 and the LPC rotor 25 are connected to and driven by the LPT rotor 28 through a low speed shaft 33. The HPC rotor 26 is connected to and driven by the HPT rotor 27 through a high speed shaft 34. The shafts 32-34 are rotatably supported by a plurality of bearings 36; e.g., rolling element and/or thrust bearings. Each of these bearings 36 is connected to the engine housing 22 by at least one stationary structure such as, for example, an annular support strut.

During operation, air enters the turbine engine 10 through the airflow inlet 14, and is directed through the fan section 18 and into a core gas path 38 and a bypass gas path 40. The air within the core gas path 38 may be referred to as "core air". The air within the bypass gas path 40 may be referred to as "bypass air". The core air is directed through the engine sections 19-21, and exits the turbine engine 10 through the airflow exhaust 16 to provide forward engine thrust. Within the combustor section 20, fuel is injected into a combustion chamber 42 and mixed with compressed core air. This fuel-core air mixture is ignited to power the turbine engine 10. The bypass air is directed through the bypass gas path 40 and out of the turbine engine 10 through a bypass nozzle 44 to provide additional forward engine thrust. This additional forward engine thrust may account for a majority (e.g., more than 70 percent) of total engine thrust. Alternatively, at least some of the bypass air may be directed out of the turbine engine 10 through a thrust reverser to provide reverse engine thrust.

FIG. 1 represents one possible configuration for an engine 10. Aspects of the disclosure may be applied in connection with other environments, including additional configurations for gas turbine engines, including but not limited to turbojets, turboprops, low bypass ratio gas turbine engines, and high bypass ratio turbine engines. This includes configurations with multiple flow streams and with and without thrust augmentation.

Figure 2:
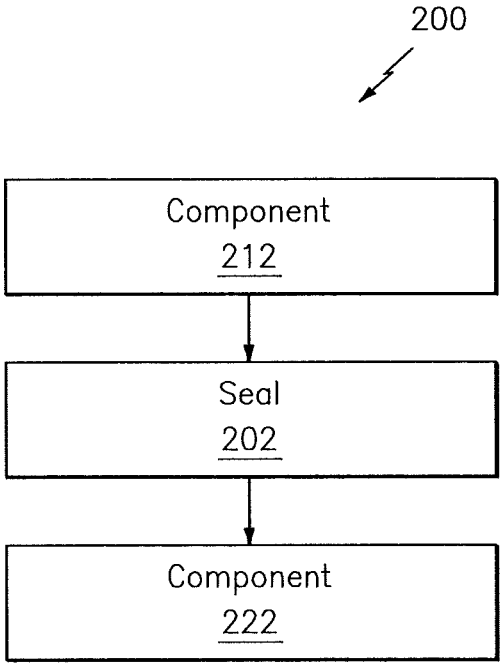
FIG. 2 illustrates a block diagram of a system incorporating a seal in accordance with aspects of this disclosure.

Referring now to FIG. 2, a system 200 is shown. The system 200 may be included as part of an engine. The system 200 may be incorporated as part of one or more sections of the engine, such as for example the turbine section 21 of the engine 10 of FIG. 1.

The system 200 is shown as including a seal 202 that bridges/interfaces a first component 212 and a second component 222. The components 212 and 222 may correspond to adjacent, segmented hot section gaspath components associated with static and rotating turbine airfoils and segmented blade outer air seals. More generally, the components 212 and 222 may pertain to platforms, mate faces, buttresses, spindles, bosses, rails, hooks, etc.

The seal 202 may adhere to one or more types or configurations. For example, aspects of the seal 202 may share characteristics in common with a "W" seal. "W" seals are known to those of skill in the art; as such, a complete description of such seals is omitted herein for the sake of brevity. Illustrative embodiments of "W" seals are described in U.S. Pat. No. 8,651,497, the contents of which are incorporated herein by reference. Another configuration may be a "feather seal" or "platform seal".

Figure 3:
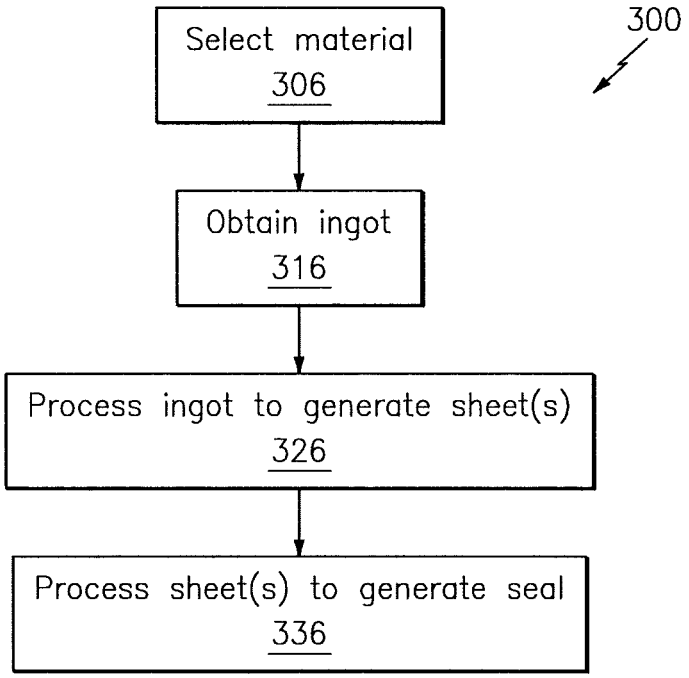
FIG. 3 illustrates a method for manufacturing a seal in accordance with aspects of this disclosure.
Figure 6:
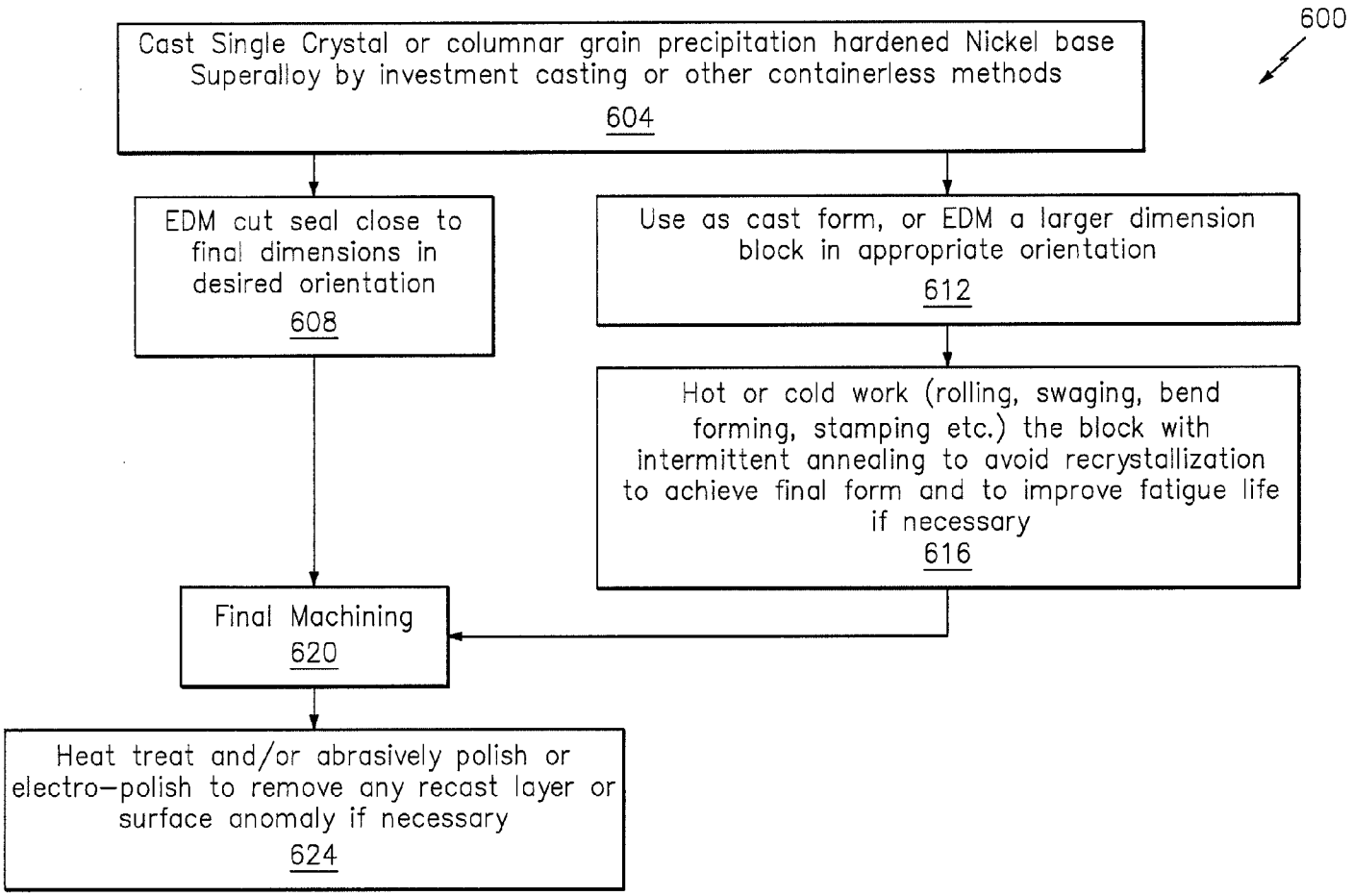
FIGS. 6-7 illustrate methods for manufacturing a seal in accordance with aspects of this disclosure.
Figure 7:
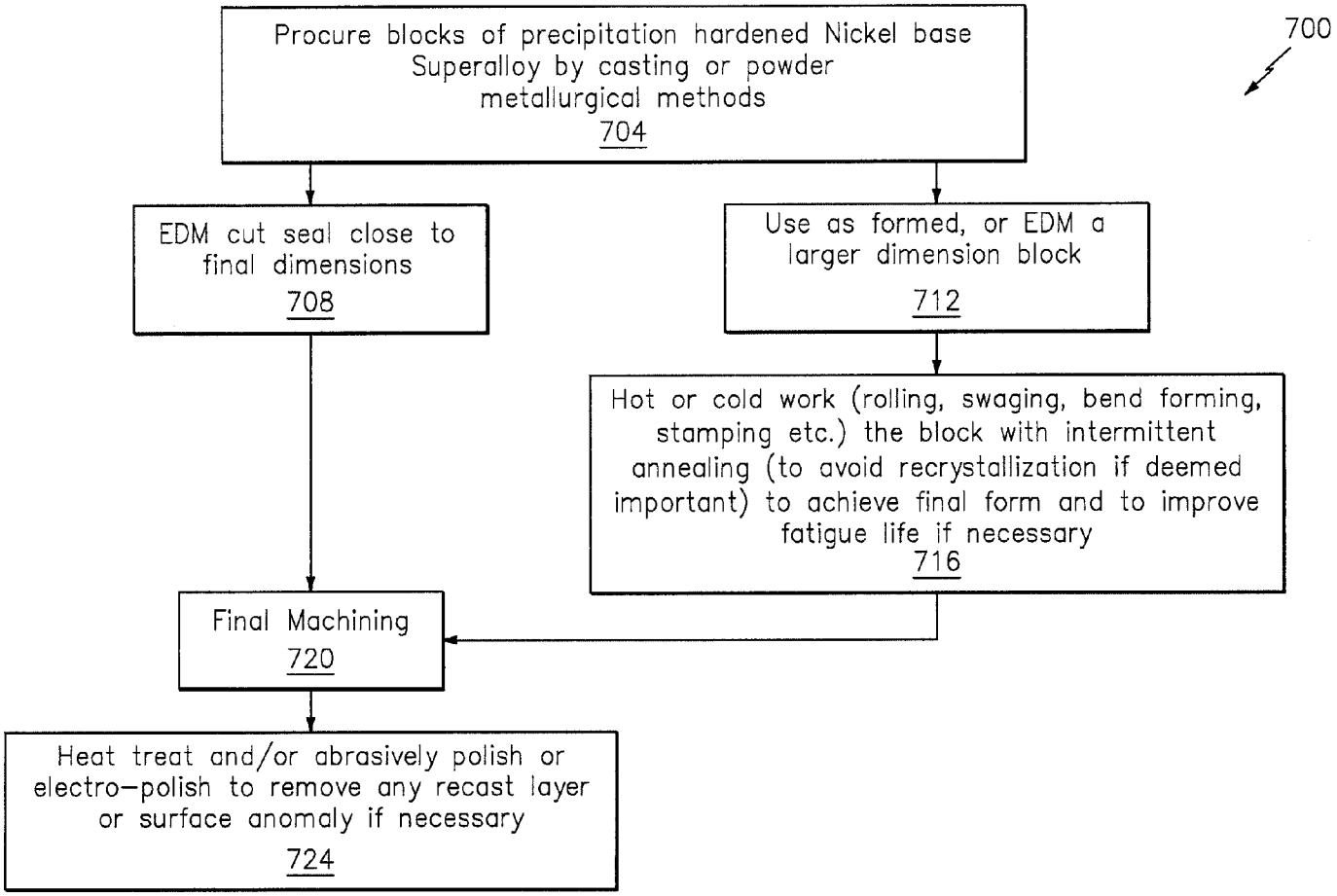

Various procedural/methodological acts may be undertaken to generate a seal (e.g., the seal 202). For example, FIGS. 3, 6, and 7 illustrate flowcharts of methods 300, 600, and 700 for designing and fabricating a seal. In some embodiments, an aspect of a first of the methods (e.g., method 300) may be combined with one or more aspects of one or more of the other methods (e.g., method 600 and/or method 700).

In block 306, a material from which the seal is to be fabricated may be selected. The particular material that is selected may be based on one or more parameters, such as for example a temperature or a pressure in an application environment in which the seal is to be incorporated. In some embodiments, the material may include solid solution hardened nickel base alloys or precipitation hardened nickel base alloys. Alloys of latter type typically contain elements such as Al, Ti, Ta and Nb, that can form precipitates of the type Ni3(Al,X), where X includes at least one element other than aluminum. X may include a refractory element.

In some embodiments, the material of block 306 may be a single crystal precipitation hardened nickel base superalloy to impart high temperature creep resistance. An orientation of the single crystal may be selected dependent on the application environment in which the seal is to be incorporated. For example, a <100> orientation with low Young's modulus may be selected to improve thermal fatigue resistance or a <111> orientation with the highest modulus may be selected to increase its natural frequency in a vibratory environment.

Aspects of the disclosure may utilize precipitation hardened nickel base alloys in fine grained polycrystalline form procured by a powder metallurgical approach, or a coarse grain polycrystalline form procured by conventional casting, or a columnar grain and single crystal form procured by directional solidification (see blocks 604, 704). Such techniques may be applied in the aerospace and industrial gas turbine industry. For example, many components such as blades, vanes, blade outer air seals and combustor panels as well as disks and shafts and other rotating components may be constructed. Components may be fabricated with at least one dimension being less than 0.050 inches (1.27 millimeters) from this class of alloys. It is tacitly assumed that, conventionally, cutting and machining, and forming material to such a thin dimension is impossible or difficult with material curling up owing to residual stress or not allowing to maintain the dimensional tolerance.

In block 316, an ingot of the material selected in block 306 may be obtained from one or more sources.

In block 326, the ingot of block 316 may be processed to generate one or more sheets of the material. Such sheet(s) may be used in the construction of one or more feather seals (see, e.g., U.S. Pat. No. 5,531,457 for a description of a gas turbine engine with a feather seal arrangement—the contents of U.S. Pat. No. 5,531,457 are incorporated herein by reference).

Figure 8:
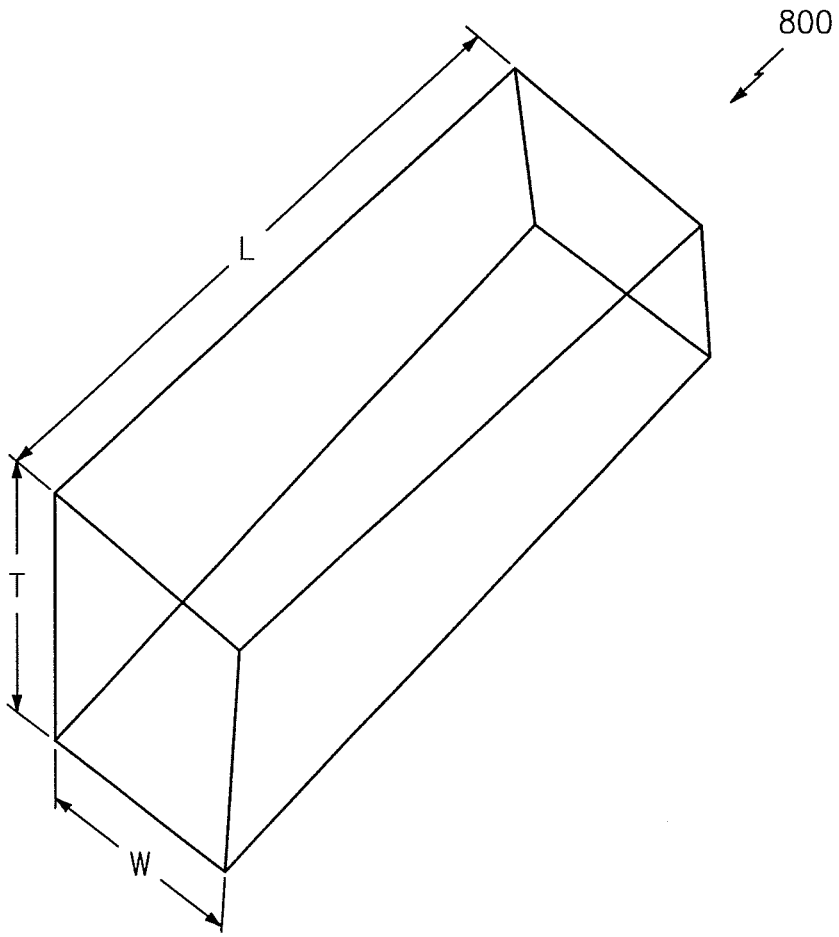
FIG. 8 illustrates a sheet that may be used to form a seal in accordance with aspects of this disclosure.

Referring to FIG. 8, in some embodiments a sheet 800 that is used to produce one or more seals may be generated to adhere to one or more predetermined dimensions. For example, the sheet 800 may be approximately 0.010 inches (0.254 millimeters) to 0.050 inches (1.27 millimeters) thick 'T'. To accommodate the production of seals for large industrial gas turbine engines the sheet may be approximately 6.0 inches (152.4 millimeters) long 'L'. The width 'W' of the sheet will also vary based on the seal(s) being produced. The width may be between 0.1 inches (2.54 millimeters) and 6.0 inches (152.4 millimeters), thus allowing a single or multiple seals to be produced from each sheet.

Figure 4:
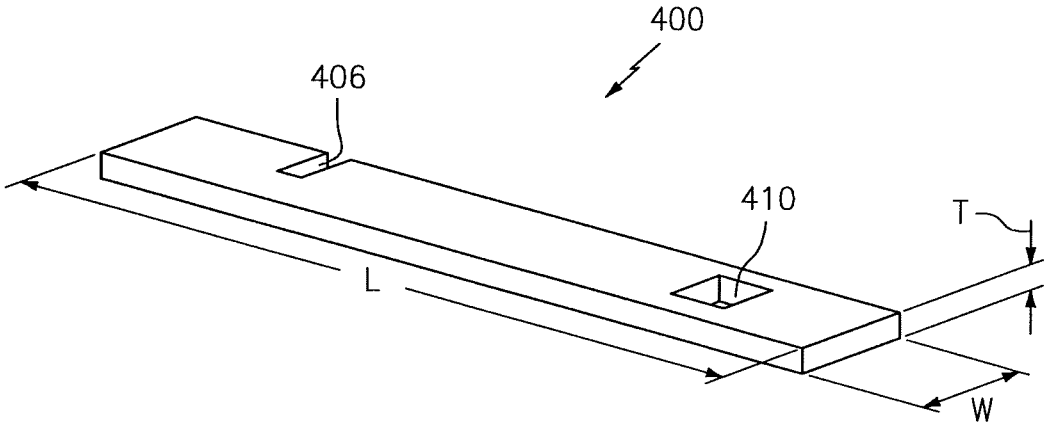
FIGS. 4-5 illustrate exemplary seals in accordance with aspects of this disclosure.

Referring to FIG. 4, a seal 400 may be substantially rectangular/cube-like in shape having a thickness 'T', a length 'L', and a width 'W'. Feather seal dimensions may vary based on engine application and size and/or the size of the interfacing components. Turbine feather seals produced from nickel single crystal material may have a thickness 'T' in the range of 0.010 inches (0.254 millimeters) to 0.050 inches (1.27 millimeters), a length in the approximate range of 0.5 inches (12.7 millimeters) to 6.0 inches (152.4 millimeters), and a width 'W' in the approximate range of 0.1 inches (2.54 millimeters) to 0.5 inches (12.7 millimeters). Feather seals may be flat or curved. Curved seals may have one or more simple or compound bend radii. The approximate minimum bend radius may be 0.015 inches (0.381 millimeters). The approximate minimum bend angle may be 60 degrees.

For seal configurations where the utmost flexibility of the seal is desired the single crystal material may be oriented such that the high modulus direction is substantially parallel to the major axis of the feather or platform seal. For configurations where the seal may be required to perform other functions the high modulus direction may be substantially perpendicular to the major axis of the feather or platform seal.

The techniques that are applied in block 326 to form the sheet may include electro discharge machining (EDM) (see blocks 608, 612, 708, 712) or an abrasive material cutting or lapping technique similar to what is frequently done in formation of semiconductor materials (see, e.g., U.S. Pat. No. 6,568,384, the contents of which are incorporated herein by reference). In some embodiments, one or more casting techniques may be applied in connection with one or both of blocks 316 and 326 (see also block 612). Still further, in some embodiments a rolling technique or rolls may be applied to reduce/eliminate material fatigue (see, e.g., U.S. Pat. No. 3,803,890 for a description of rolling in connection with metal fatigue; the contents of U.S. Pat. No. 3,803,890 are incorporated herein by reference) (see also blocks 616, 716). The rolling technique may provide for a flat, single curve, or compound curve sheet.

Figure 5:
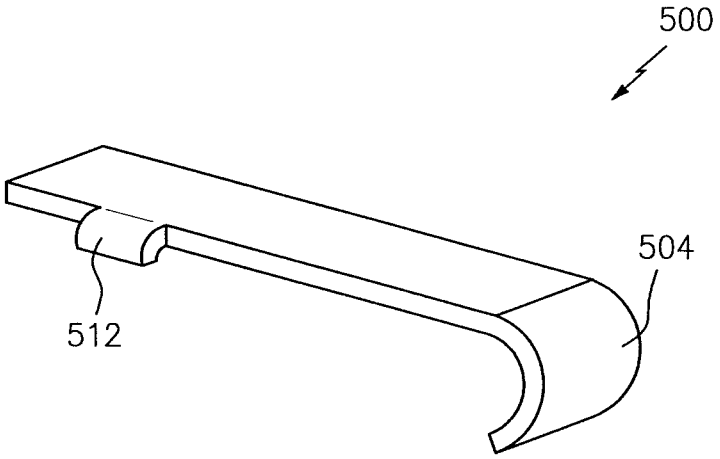

In block 336 (see also blocks 620, 720), the sheet(s) that is/are obtained in block 326 may be processed to generate a final form/form-factor for the seal. As part of block 336, one or more techniques may be applied. For example, in some embodiments one or more notches/slots (e.g., notch 406, slot 410 of FIG. 4) may be foliated in the seal 400 to accommodate interfacing to one or more components (e.g., component 212 and/or component 222 of FIG. 2, another seal, etc.). Referring briefly to FIG. 5, in some embodiments arcs 504 or bent tabs 512 may be introduced in a seal 500 by various forming techniques to provide for interfacing similar to that described above. In some embodiments, a coating (e.g., a thermal barrier coating and/or an oxidation resistant metallic coating) may be applied as part of block 336. As part of block 336 (see also blocks 624, 724), heat treatment and/or polishing techniques may be applied to remove any recast layer or surface anomaly.

The methods 300, 600, and 700 are illustrative. The blocks/operations that are shown in FIGS. 3, 6, and 7 are illustrative. In some embodiments one or more of the blocks (or one or more portions thereof) may be optional. In some embodiments, additional blocks/operations not shown may be included. In some embodiments, the blocks/operations may be executed in an order/sequence that is different from what is shown and described. Still further, while the blocks are shown and described above as discrete operations for the sake of illustrative convenience, one skilled in the art will appreciate that a first aspect of a first block may be executed concurrently (or merged) with a second aspect of a second block.

Technical effects and benefits of this disclosure include enhanced confidence in the design and manufacture of an engine. For example, aspects of the disclosure may provide for a seal that can accommodate elevated temperatures (e.g., temperatures above 2000 degrees Fahrenheit (approximately 1093 degrees Celsius)) while still adhering to small form-factor/package constraints. In this respect, the seal might not serve as a limiting factor in the design of engines that are increasingly operating at elevated temperatures with limited space available for incorporating the seal. Reliability/durability of the engine and the engine's various components may be increased/maximized as a result. The seal that is obtained may be of increased strength relative to conventional seals and may be ductile at room and/or operating temperatures.

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional in accordance with aspects of the disclosure. One or more features described in connection with a first embodiment may be combined with one or more features of one or more additional embodiments.

What is claimed is:

1. A method for forming a seal configured to interface with at least a first component and a second component of a gas turbine engine, the method comprising:

obtaining an ingot, the obtained ingot including a powder material, or a cast material, or a columnar grained material or a single crystal material from a precipitation hardened nickel base superalloy containing at least 40% by volume of the precipitate of the form Ni3(Al, X), where X is a metallic or refractory element; and processing the ingot to generate a sheet, wherein the sheet has a thickness within a range of 0.01 inches and 0.05 inches inclusive, and wherein the processing of the ingot includes applying a rolling technique.

2. The method of claim 1, wherein the sheet is substantially shaped as at least one of a rectangle or a square.

3. The method of claim 1, wherein the processing of the ingot includes applying an electro discharge machining technique.

4. The method of claim 1, wherein at least one of the obtaining or the processing includes applying a casting technique.

5. The method of claim 1, wherein application of the rolling technique provides a flat, single curve, or compound curve sheet.

6. The method of claim 1, further comprising:

forming a notch or slot in the sheet to accommodate an interface associated with at least one of the first component or the second component.

7. The method of claim 1, further comprising:

forming an arc or bent tab in the sheet.

8. The method of claim 1, further comprising:

applying at least one of a thermal barrier coating or an oxidation resistant metallic coating to the sheet in forming the seal.

9. The method of claim 1, wherein the metallic or refractory element includes at least one of Ti, Ta, or Nb.

* * * * *